US007508287B2

(12) United States Patent
Saito et al.

(10) Patent No.: US 7,508,287 B2
(45) Date of Patent: Mar. 24, 2009

(54) BAND-PASS FILTER

(75) Inventors: Akihiko Saito, Nagoya (JP); Kazuhisa Tsutsui, Nagoya (JP)

(73) Assignee: Diado Tokushuko Kabushiki Kaisha (JP)

( * ) Notice: Subject to any disclaimer, the term of this patent is extended or adjusted under 35 U.S.C. 154(b) by 226 days.

(21) Appl. No.: 11/519,889

(22) Filed: Sep. 13, 2006

(65) Prior Publication Data

US 2007/0057750 A1 Mar. 15, 2007

(30) Foreign Application Priority Data

Sep. 15, 2005 (JP) ..... 2005-269272

(51) Int. Cl.
*H01P 1/20* (2006.01)

(52) U.S. Cl. ..... 333/204; 333/202

(58) Field of Classification Search ..... 333/202, 333/204

See application file for complete search history.

(56) References Cited

U.S. PATENT DOCUMENTS 5,075,646 A 12/1991 Morse
5,616,538 A 4/1997 Hey-Shipton
5,654,681 A * 8/1997 Ishizaki et al. ..... 333/204
5,982,249 A 11/1999 Bruns

FOREIGN PATENT DOCUMENTS

JP 62-254501 A2 11/1987
JP 2005-192150 7/2005

* cited by examiner

*Primary Examiner*—Vibol Tan
*Assistant Examiner*—Thienvu V Tran
(74) *Attorney, Agent, or Firm*—Bacon & Thomas, PLLC

(57) ABSTRACT

The present invention provides a band-pass filter having: a first substrate; a second substrate; an input line; an output line; a ground layer; and an electromagnetic wave absorptive layer, the input line being provided on a first surface of the first substrate, the input line extending from a first edge thereof toward a second edge thereof, the output line being provided on a second surface of the first substrate, the output line extending from the second edge thereof toward the first edge thereof, the input line and the output line forming an overlapping line, the output line being sandwiched between a first surface of the second substrate and the second surface of the first substrate, the ground layer being provided on a second surface of the second substrate; the electromagnetic wave absorptive layer being provided on the first surface of the first substrate, the electromagnetic wave absorptive layer covering the input line.

8 Claims, 3 Drawing Sheets

BAND-PASS FILTER

FIELD OF THE INVENTION

The present invention relates to a band-pass filter. More specifically, the present invention relates to a band-pass filter which is miniaturized and has an enhanced characteristic.

BACKGROUND OF THE INVENTION

Electromagnetic waves in frequency bands of hundreds of megahertz to tens of gigahertz have hitherto been used by communication means. Frequency bands are distributed; for instance, a frequency band of 800 MHz (0.8 GHz) or a frequency band of 1.5 GHz band is allocated for mobile telephones; a frequency band of 1.9 GHz band is allocated for a personal handy phone system; a frequency band of 5.8 GHz band is allocated for an ETC (electronic toll collection) apparatus installed at a highway; a frequency band of 2.4 GHz band or 5.2 GHz band is allocated for a wireless LAN; and a frequency band of 5.8 GHz is allocated to DSRC (dedicated short range communication).

Electromagnetic waves in these frequency bands are utilized in connection with automobile operations, or such utilization is highly feasible. Plans are now afoot to receive these electromagnetic waves by use of a single antenna and to subject the received electromagnetic waves to digital processing, thereby collectively utilizing the electromagnetic waves. In such a case or a case where each of the electromagnetic waves in these frequency bands is solely used, there is required a band-pass filter which allows transmission of a signal in only a predetermined band among the frequency bands and blocks the other signals, in order to process data while blocking noise induced from harmonic waves or reflected waves.

In order to meet the demand, the present applicant has developed several electromagnetic shielding materials which are formed by dispersing powder of soft magnetic materials into a rubber or plastic matrix, and has put them into practical use.

One of the present inventors has already proposed a low-pass filter utilizing the electromagnetic-wave absorptive shielding material (as described in JP-A-2002-171104), and has also proposed a band-pass filter for gigahertz band to be used in frequency bands of hundreds of megahertz to tens of gigahertz by utilization of expertise in that low-pass filter (as described in JP-A-2004-222086).

FIGS. 4A and 4B shows an example of the thus-proposed band-pass filter for gigahertz band.

As shown in FIGS. 4A and 4B, a band-pass filter for gigahertz band 100 is formed by: placing an input signal line 102 and an output signal line 103 on the surface of a sheet 101 with an interval therebetween, the signal lines being formed form a conductor strip and running in a series direction; connecting mutually-opposing ends of the lines 102, 103 together with a chip capacitor 105 sandwiched therebetween; and placing a GND line 104 on the back of the sheet 101.

However, there is a problem of difficulty being encountered in miniaturizing the band-pass filter for gigahertz band.

In order to miniaturize the band-pass filter for gigahertz band 100, it is better to use a ceramic substrate of high complex relative permittivity for the sheet 101, which is a dielectric substrate, in such a way that a wavelength is compressed. However, when a ceramic substrate of high complex relative permittivity is used for the sheet 101, a connection of electromagnetic waves to the GND line 104 is interrupted, which leads to a failure to achieve a sufficient shielding effect.

This raises another problem of deterioration of a rise characteristic and a fall characteristic.

SUMMARY OF THE INVENTION

The present invention has been conceived in light of the above drawbacks in the related art, and aims at providing a band-pass filter which is miniaturized and has enhanced characteristics.

The present inventors have made eager investigation to examine the problem. As a result, it has been found that the foregoing objects can be achieved by the following band-pass filters. With this finding, the present invention is accomplished.

The present invention is mainly directed to the following items:

1. A band-pass filter comprising: a first substrate; a second substrate; an input line; an output line; a ground layer; and an electromagnetic wave absorptive layer, the input line being provided on a first surface of the first substrate, the input line extending from a first edge thereof toward a second edge thereof, the output line being provided on a second surface of the first substrate, the output line extending from the second edge thereof toward the first edge thereof, the input line and the output line forming an overlapping line, the output line being sandwiched between a first surface of the second substrate and the second surface of the first substrate, the ground layer being provided on a second surface of the second substrate; the electromagnetic wave absorptive layer being provided on the first surface of the first substrate, the electromagnetic wave absorptive layer covering the input line.

2. The band-pass filter according to item 1, wherein a complex relative permittivity of the first substrate is an integral multiple of a complex relative permittivity of the second substrate.

3. The band-pass filter according to item 1, wherein a length of the overlapping line is set by the following equation:

$$fn=K\times(C_0/L)$$

wherein fn denotes the notch frequency, K denotes the substrate factor, $C_0$ denotes the speed of light, and L denotes the length of the overlapping line.

4. The band-pass filter according to item 1, wherein the first substrate and the second substrates are ceramic substrates.

The band-pass filter of the present invention yields a superior advantage of a band-pass filter for gigahertz band being miniaturized.

The present invention can be applied to a band-pass filter for gigahertz band.

BRIEF DESCRIPTION OF THE DRAWINGS

FIG. 1 is a schematic diagram of a band-pass filter according an embodiment of the present invention, wherein

Figure 1A:
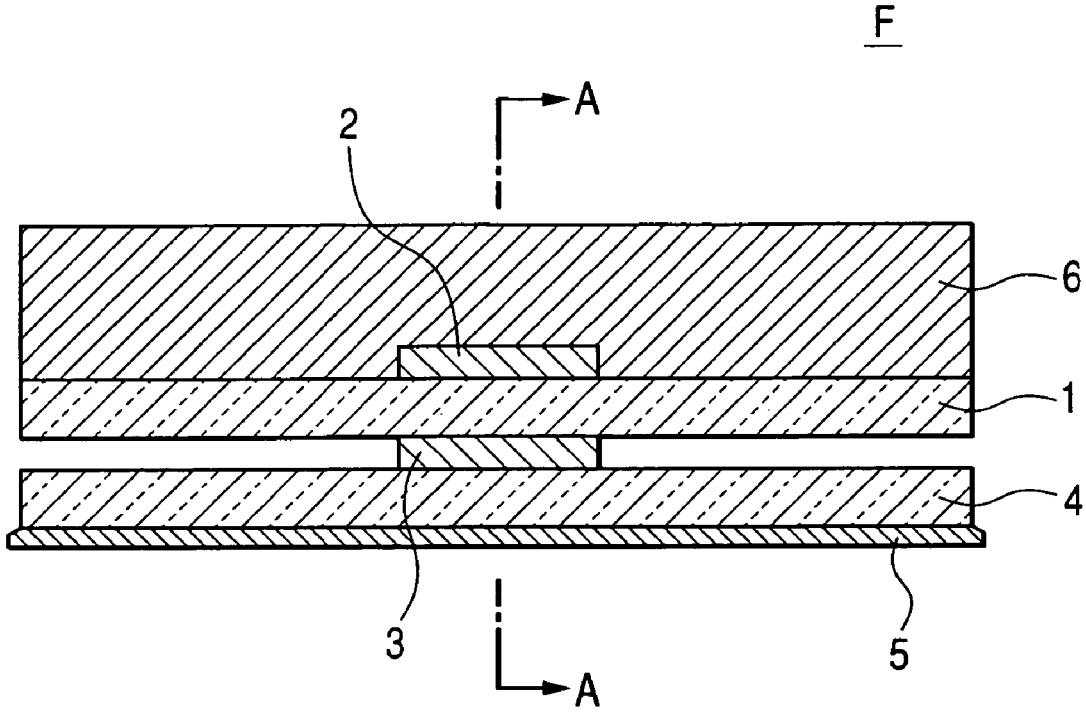
FIG. 1A is a front view and FIG. 1B is a cross-sectional view taken along line A-A of the front view.

The reference numerals used in the drawings denote the followings, respectively.

F Band-pass filter
1 First substrate
2 Input line
3 Output line
4 Second substrate
5 Ground layer
6 Electromagnetic wave absorptive

DETAILED DESCRIPTION OF THE INVENTION

An embodiment of the present invention will be described hereinbelow by reference to the accompanying drawings. However, the present invention is not to be construed as being limited thereto.

A band-pass filter according to an embodiment of the present invention is shown in FIG. 1.

Figure 1B:
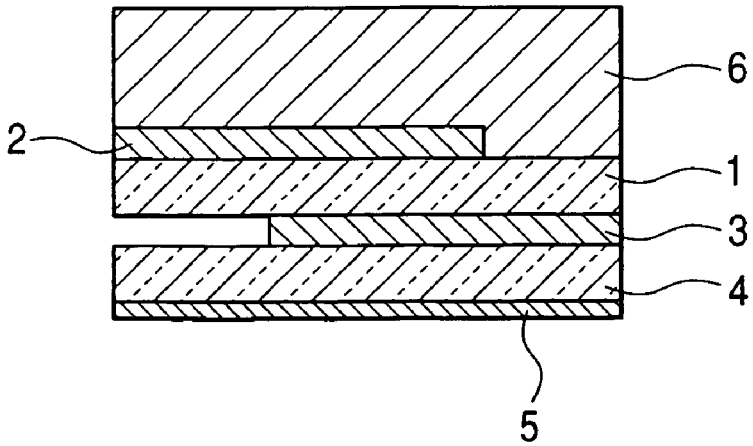

As shown in FIGS. 1A and 1B, a band-pass filter F comprises a first substrate 1; a strip-shaped input line 2 which is placed on one surface (an upper surface in FIGS. 1A and 1B) of the first substrate so as to be oriented from one side edge toward the other side edge thereof and is of predetermined length; an output line 3 which is placed on a back surface (a lower surface in FIGS. 1A and 1B) of the first substrate 1 so as to be oriented from the other side edge toward the one side edge so as to overlap the input line 2 and is of predetermined length; a second substrate 4 placed below the output line 3 in the drawing such that the output line 3 is sandwiched between the first substrate 1 and the second substrate 4; a ground layer 5 provided on the back of the second substrate 4; and an electromagnetic wave absorptive layer 6 provided so as to cover the front surface of the first substrate 1.

The first substrate 1 is an insulating substrate formed from, e.g., ceramic, and a complex relative permittivity er1 of the first substrate ranges is preferably from 3 to 1000. Barium-titanate-based materials are preferably used as ceramic.

The input line 2 is formed from a conductive material; e.g., gold (Au). The size of the input line 2 is adjusted, as appropriate, according to an electromagnetic wave for which this band-pass filer is used. By way of an example, the input line 2 has a width of 0.05 mm, a length of 3 mm, and a thickness of 1 to 5 μm.

The output line 3 is formed from a conductive material; e.g., gold (Au). The size of the input line 3 is adjusted, as appropriate, according to an electromagnetic wave for which this band-pass filer is used. By way of an example, the input line 3 has a width of 0.1 mm, a length of 2 mm, and a thickness of 1 to 5 μm.

The length L (hereinafter referred to as "overlap length") of an overlapping line between the input line 2 and the output line 3 is adjusted, as appropriate, according to the frequency of an electromagnetic wave which is allowed to pass through the band-pass filter.

More specifically, the overlap length L is adjusted according to Equation 1 provided below, which is a relational expression between the overlap length L and a notch frequency fn.

$$fn=K\times(C_0/L) \quad (1)$$

wherein fn denotes the notch frequency, K denotes the substrate factor, $C_0$ denotes the speed of light, and L denotes the length of the overlapping line. In the present invention, the notch frequency denotes the frequency at the attenuation of the S-parameter of the transmission. The notch frequency is set in view of required characteristics of the band-pass filter. Besides, the substrate factor K is determined by: metallic powder filling ratios of the first substrate and the second substrate; the particle sizes of the metallic powders; materials of the first substrate, the second substrate and the metallic powders; complex relative permittivities of the first substrate and the second substrate; and the like. One of ordinary skill in the art can specify the substrate factor K when the constitutions of the first substrate and the second substrate are provided.

From a general relational expression among a wave speed v, a wavelength λ, and a frequency f ($v=\lambda f$, wherein $v=C_0$) and Equation 1 (wherein K=12000), provided that the frequency of electromagnetic wave transmitting through the band-pass filter is 6 GHz, the overlap length L calculated to be 5 cm. Provided that the frequency of electromagnetic wave transmitting through the band-pass filter is 3.0 GHz, the overlap length L calculated to be 10 cm.

For example, the second substrate 4 is an insulative substrate formed from ceramic, and the complex relative permittivity er2 thereof is preferably from 1.5 to 500. Specifically, the complex relative permittivity er2 of the second substrate 4 is preferably adjusted within its range such that a ratio of the complex relative permittivity er1 of the first substrate 1 to the complex relative permittivity er2 of the second substrate 4 is an integral number. Namely, the ratio of the complex relative permittivity er1 of the first substrate 1 to the complex relative permittivity er2 of the second substrate 4 is an integral ratio.

More preferably, the ratio of the value of the er1 to the value of the er2 is adjusted to about 2:1; for instance, the complex relative permittivity er1 of the first substrate 1 is a value of 200 and the complex relative permittivity er2 of the second substrate 2 is a value of 100, or the complex relative permittivity er1 of the first substrate 1 is a value of 300 and the complex relative permittivity er2 of the second substrate 2 is a value of 150.

Thereby, the first wavelength of the first substrate 1 becomes equal to about half wavelength of the second substrate 4. As a result, the input line 2 is matched with the output line 3, and transmission of a signal between the lines is facilitated. Consequently, even when a material having high complex relative permittivity is used for the substrates 1 and 2, a connection between the ground layer 5 and electromagnetic waves is not interrupted. Superior rise and fall roll-off characteristics can be attained.

In short, the ratio of the complex relative permittivity er1 of the first substrate 1 to the complex relative permittivity er2 of the second substrate 4 is set to an integral ratio, whereby the electric field of an electromagnetic wave extends in the vertical direction thereof and wavelength compression is readily achieved. Specifically, the electric field becomes vertical and the magnetic field becomes horizontal with respect to a propagating direction, and the transmission mode becomes equivalent to a transmission mode of a quasi-TEM wave. As a result, unnecessary coupling in the element is prevented.

Barium-titanate-based materials are preferably used as the ceramic employed for the second substrate 4.

The ground layer 5 is formed from, e.g., a phosphor bronze plate or gold.

The electromagnetic wave absorptive layer 6 is formed by: dispersing soft magnetic metal powder into a matrix of synthetic resin such as liquid-crystal polymer; and forming the mixture into a sheet. For example, an electromagnetic wave absorber DPI (Trade Name) supplied from Daido Steel Co., Ltd. is mentioned as the electromagnetic wave absorptive layer 6.

As mentioned above, the band-pass filter of the present embodiment uses a ceramic plate of high complex relative permittivity for the substrate, and the substrate is stacked into two layers. Further, the complex relative permittivity of the second substrate located on the ground side is made substantially one-half the complex relative permittivity of the first substrate located above the second substrate. Accordingly, an attempt to miniaturize the band-pass filter and enhance characteristics thereof can be realized.

EXAMPLES

The present invention is now illustrated in greater detail with reference to Examples and Comparative Examples, but it should be understood that the present invention is not to be construed as being limited thereto.

Example 1 and Comparative Examples 1 and 2

Figure 2:
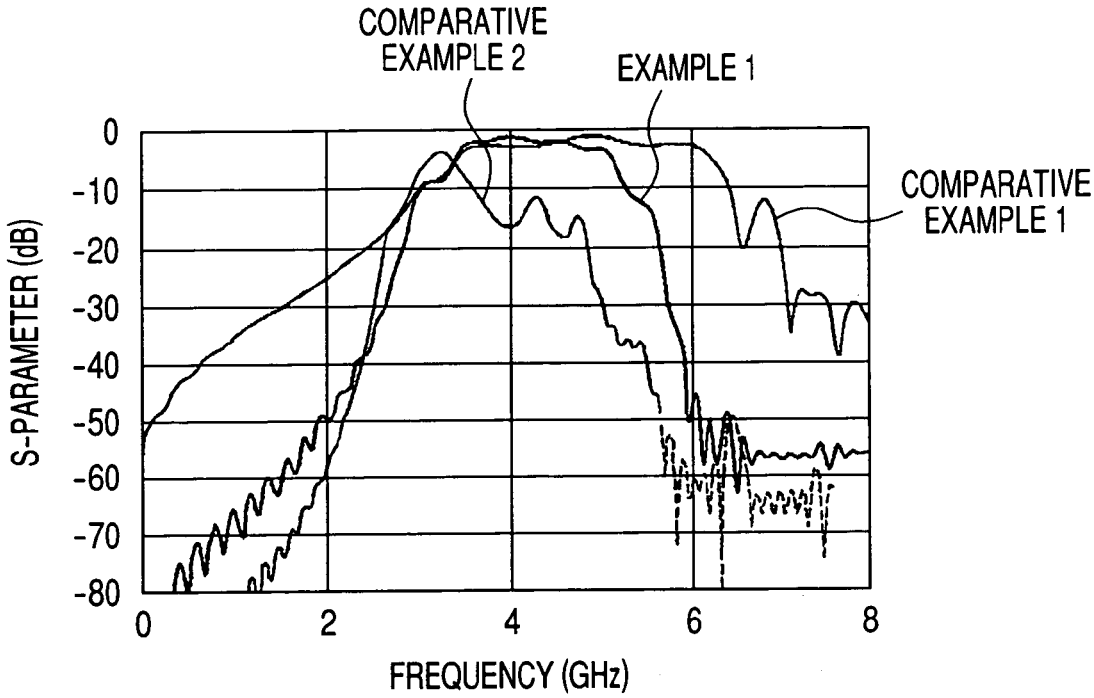
FIG. 2 is a graph showing frequency characteristics of transmission factors of an Example and those of Comparative Examples.

In Example 1, a complex relative permittivity er1 of the first substrate 1 of the band-pass filter F of the embodiment is set to 197, and the complex relative permittivity er2 of the second substrate 4 is set to 90. In Comparative Example 1, a substrate of high complex relative permittivity is used for a band-pass filter formed from a related-art, general, single-layer substrate. In Comparative Example 2, a band-pass filter has the same double-layer structure as does the band-pass filter F of the embodiment, and the substrates 1 and 4 are provided with the same complex relative permittivity. Frequency characteristics of transmission factors (S21 of an S parameter in a two-port network) of Example 1, Comparative Example 1, and Comparative Example 2 are shown in FIG. 2 in a comparative manner. The electromagnetic wave absorptive layer 6 is omitted from the band-pass filter of Example 1 so as to achieve equality to the band-pass filters of Comparative Example 1 and Comparative Example 2 in terms of conditions.

In Comparative Example 1, a comparatively-flat characteristic is achieved in a pass band (a frequency band of about 3.5 to 6 GHz). However, sufficiently-steep characteristics are not achieved at a rise and a fall, particularly a fall. In short, desired rise and fall roll-off characteristics are not achieved.

In Comparative Example 2, the rise and the fall are comparatively steep. However, a flat characteristic is not achieved in the pass band (a frequency band of about 3 to 5 GHz). Desired pass band characteristics are not achieved.

In contrast, in Example 1, steep characteristics are achieved at both a rise and a fall. A flat characteristic is also achieved in the pass band (a frequency band of about 3.5 to 5 GHz). In other words, desired rise and fall roll-off characteristics and a desired pass band characteristic are achieved.

Example 2

Figure 3:
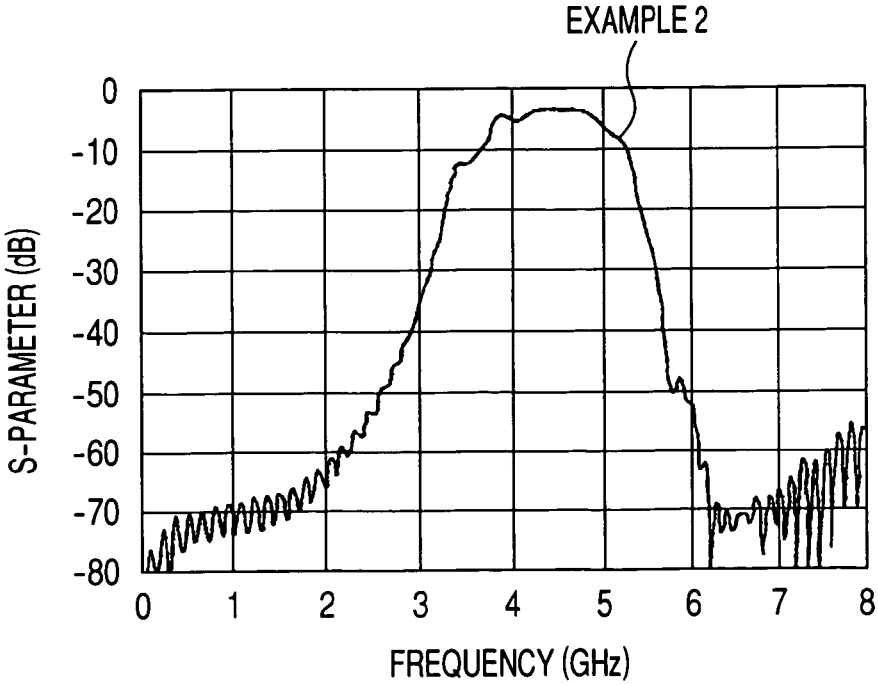
FIG. 3 is a graph showing frequency characteristic of a transmission factor of another Example.
Figure 4A:
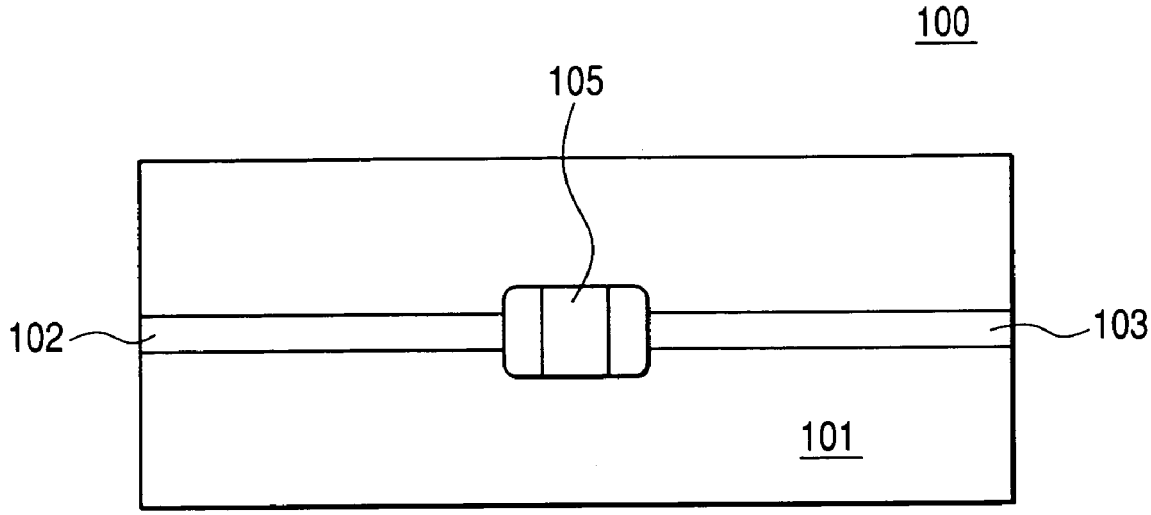
FIGS. 4A and 4B is a schematic diagram of a band-pass filter proposed in JP-A-2004-222086.
Figure 4B:
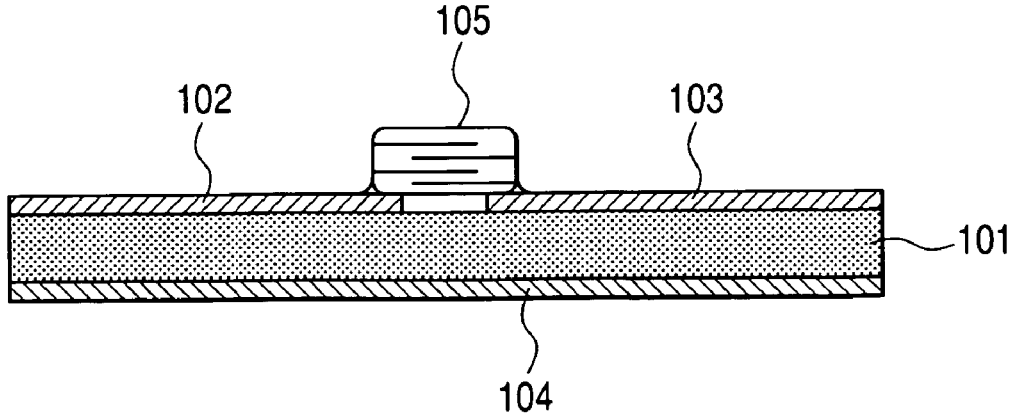

In the band-pass filter F (Example 2), the permittivities of the respective substrates 1, 4 are set so as to become the same as those of Example 1, and the band-pass filter has the electromagnetic wave absorptive layer 6 containing soft magnetic metal powder in an amount of 5% (volume percentage). FIG. 3 shows a frequency characteristic of transmission factors of the band-pass filter F.

As shown in FIG. 3, rise and fall roll-off characteristics which are steeper than those achieved in Example 1 are achieved in Example 2. Therefore, providing the electromagnetic wave absorptive layer 6 is understood to enable achievement of more desirable filter characteristics.

While the present invention has been described in detail and with reference to specific embodiments thereof, it will be apparent to one skilled in the art that various changes and modifications can be made therein without departing from the spirit and scope thereof The present application is based on Japanese Patent Application No. 2005-269272 filed on Sep. 15, 2005, and the contents thereof are incorporated herein by reference.

What is claimed is:

1. A band-pass filter comprising:

a first substrate;

a second substrate;

an input line;

an output line;

a ground layer; and an electromagnetic wave absorptive layer, the input line being provided on a first surface of the first substrate, the input line extending from a first edge thereof toward a second edge thereof, the output line being provided on a second surface of the first substrate, the output line extending from the second edge thereof toward the first edge thereof, the input line and the output line forming an overlapping line, the output line being sandwiched between a first surface of the second substrate and the second surface of the first substrate, the ground layer being provided on a second surface of the second substrate;

the electromagnetic wave absorptive layer being provided on the first surface of the first substrate, the electromagnetic wave absorptive layer covering the input line;

wherein the electromagnetic wave absorptive layer is a synthetic resin matrix having a soft magnetic metal powder dispersed therein.

2. The band-pass filter according to claim 1, wherein a complex relative permittivity of the first substrate is an integral multiple of a complex relative permittivity of the second substrate.

3. The band-pass filter according to claim 1, wherein a length of the overlapping line is set by the following equation:

$$fn=K\times(C_0/L)$$

wherein fn denotes the notch frequency, K denotes the substrate factor, $C_0$ denotes the speed of light, and L denotes the length of the overlapping line.

4. The band-pass filter according to claim 1, wherein the first substrate and the second substrates are ceramic substrates.

5. The band-pass filter according to claim 1, wherein the synthetic resin matrix is a liquid-crystal polymer.

6. The band-pass filter according to claim 1, wherein the soft magnetic metal powder is dispersed in the synthetic resin matrix in the amount of 5% by volume.

7. The band-pass filter according to claim 1, wherein the electromagnetic wave absorptive layer is electrically isolated from the ground layer.

8. The band-pass filter according to claim 2, wherein a ratio of the complex relative permittivity of the first substrate to the complex relative permittivity of the second substrate is 2:1.

* * * * *